United States Patent [19]

Morehouse

[11] Patent Number: 4,746,060

[45] Date of Patent: May 24, 1988

[54] POPPED CORN RECEPTACLE

[76] Inventor: James E. Morehouse, 1060 Meadow Lake Dr., #8, Vista, Calif. 92084

[21] Appl. No.: 60,499

[22] Filed: Jun. 11, 1987

[51] Int. Cl.[4] ..... B65D 77/02; B65D 81/34

[52] U.S. Cl. ..... 229/101; 229/DIG. 3; 229/DIG. 14; 206/610; 426/107; 426/111; 426/122

[58] Field of Search ..... 229/101, DIG. 3, DIG. 14, 229/902, 903; 383/3, 88, 100, 103; 206/610, 623; 220/403, 405; 426/107, 110, 111, 118, 122, 123

[56] References Cited

U.S. PATENT DOCUMENTS

| | | | |
|---|---|---|---|
| 3,507,443 | 4/1970 | Gerard | 229/DIG. 14 |
| 3,851,574 | 12/1974 | Katz et al. | 426/107 |
| 3,973,045 | 8/1976 | Brandberg et al. | 229/DIG. 3 |
| 4,036,423 | 7/1977 | Gordon | 426/111 |
| 4,038,425 | 7/1977 | Brandberg et al. | 426/111 |
| 4,571,337 | 2/1986 | Cage et al. | 229/DIG. 14 |
| 4,584,202 | 4/1986 | Roccaforte | 426/122 |
| 4,596,713 | 6/1986 | Burdette | 426/107 |

*Primary Examiner*—Willis Little

*Attorney, Agent, or Firm*—John J. Murphey

[57] ABSTRACT

A paper pouch for use in receiving newly popped corn from a hot-air type corn popper, for serving it and for storing the unused portion, folded into a paper base before use and, following unfolding, adapted to be attached to the discharge chute of a hot-air type corn popper, to receive the popped corn, and later, adapted through a series of perforations to have the upper part of the pouch removed to serve the popped corn.

6 Claims, 2 Drawing Sheets

POPPED CORN RECEPTACLE

BACKGROUND OF THE INVENTION

1. Field of the Invention

This invention pertains to the field of food serving appliances. More particularly, it pertains to the field of disposable service items for receiving expandable food from a processing unit, such as popped corn from a hot-air type corn popper, and suitable as a food-serving container as well as a storage container for the unused portion thereof.

2. Description of the Prior Art

Expandable foods such as popcorn are widely desired as a party snack or as a treat served in a bar or at a ball game. Where it is expanded in a commercial-size unit, such as the popular glass-enclosed kettle-type popper used in theaters and at circuses, the expanded corn is conventiently served in paper bags of various sizes and the uneaten corn is readily disposed of by throwing the bag in a trash receptacle.

However, when it is popped and served in the home, the convenience of the kettle-type popper and the disposable bags is unavailable, replaced with a small sized hot-air or other type corn popper and a serving bowl. Hot-air poppers circulate corn kernels in a stream of hot air such that, when the kernels pop, their billowed form and low specific gravity allows them to be blown out of the popper through a discharge chute and into a serving bowl. These type poppers have the singular annoying propensity of causing hot, unpopped kernels to be swept out of the unit with the popped kernels into the serving bowl, only to pop a few seconds later and jettison a lot of the popped corn out of the serving bowl onto the floor or into someone's face.

The uneaten corn rarely fills the serving bowl so that any that is stored in the refrigerator is either a small amount stored in a large bowl or stored in a smaller bowl thereby using twice as many containers thus increasing the demand on the dishwasher—whether mechanical or of the human variety.

The prior art has attempted to correct these problems by placing the kernels in an expandable folded pouch, either of metal foil for popping over the stove burner (see U.S. Pat. Nos. 3,425,845; 3,519,439; 3,671,270; and 3,969,535) or in a microwave oven (see U.S. Pat. Nos. 4,292,332 and 4,448,309). However, in each of these inventions, the popped corn is served right from the popping container and is greasy and often contains odorous residual oils that may stain one's hands and clothes.

The hot-air type corn-popper units, such as shown in U.S. Pat. Nos. 3,059,567; 4,072,091 and 4,512,247, call for receptacles to be interconnected with their respective discharge chutes. However, while these may solve some of the aforesaid problems they are just another item to be washed and dried after the party and stored in the cupboard, to take up space until the next party. With housing costs rising and kitchen space at a premium, these extra bulky containers and servers are a decided inconvenience.

SUMMARY OF THE INVENTION

This invention is a combination popping corn receptacle, popped corn server and storage container that overcomes all of the aforesaid problems. It comes in a slender, easily storage packet, unfolds into a pouch of varying size to receive and in which to serve the popped corn, and folds down around the uneaten corn to a small, convenient size for efficient storage in the refrigerator. While totally enclosed, it has small openings to let hot air escape but not the late-popping kernels and the top portion is thereafter easily removable to provide a convenient serving bowl. If all the popped corn is eaten or none is to be saved, the inventive pouch can be folded up and discarded to eliminate the need for washing or residual cupboard storage. If some is left over, the pouch easily folds over onto itself to provide lasting storage protection at minimal space usage. The invention adapts to fit a wide variety of hot-air type corn poppers and is inexpensive, capable of being marketed in a small container containing a plurality of pouches.

Accordingly, the main object of this invention is a novel combination popping corn receptacle, popped corn server and storage container that reduces the hazards of latent popping of corn popped in a hot-air type corn popper and that conveniently doubles as a serving container and a storage container. Other objects include a device that is inexpensive, capable of stacking for ease in marketing and storage, adaptable to a wide variety of corn poppers, available for use with different foods, safe for use by all ages and a device that reduces the need for large cupboard storage space so precious in modern homes. These and other objects of the invention will appear more clearly upon reading of the following description of the preferred embodiment taken together with the drawings attached hereto. The scope of protection claimed by the inventor may be obtained by a fair reading of the claims which conclude this specification.

DESCRIPTION OF THE PREFERRED EMBODIMENT

Figure 1:
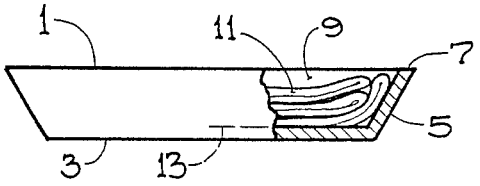
FIG. 1 is a side elevation view, partially in section, of the preferred embodiment of this invention in its folded, pre-use configuration.

FIG. 1 displays the invention in its pre-use form and shows it to comprise a base 1 defined by a flat bottom 3 of finite thickness surrounded by a thin short upwardly-extending border or side wall 5 terminating at an upper rim 7. Base 1 is thin in cross-section both along bottom 3 and around side wall 5 so as to form a depression 9 in the top thereof. Base 1 may be made of virtually any material that is able to hold its shape at room temperature such as plastics, metals, wood and the like. For ease of manufacture and saving in material costs, base 1 is preferably made of pressed paper or cardboard, either reinforced with a resin or filler or just heat pressed. Preferable are the materials used to make flat, shallow items sold under the generic name "paper plates". The planar outline of base 1 may vary from square, rectangle and the like to round shaped such as circles, ovals and the like, with a circular outline preferred for ease in manufacturing.

Figure 2:
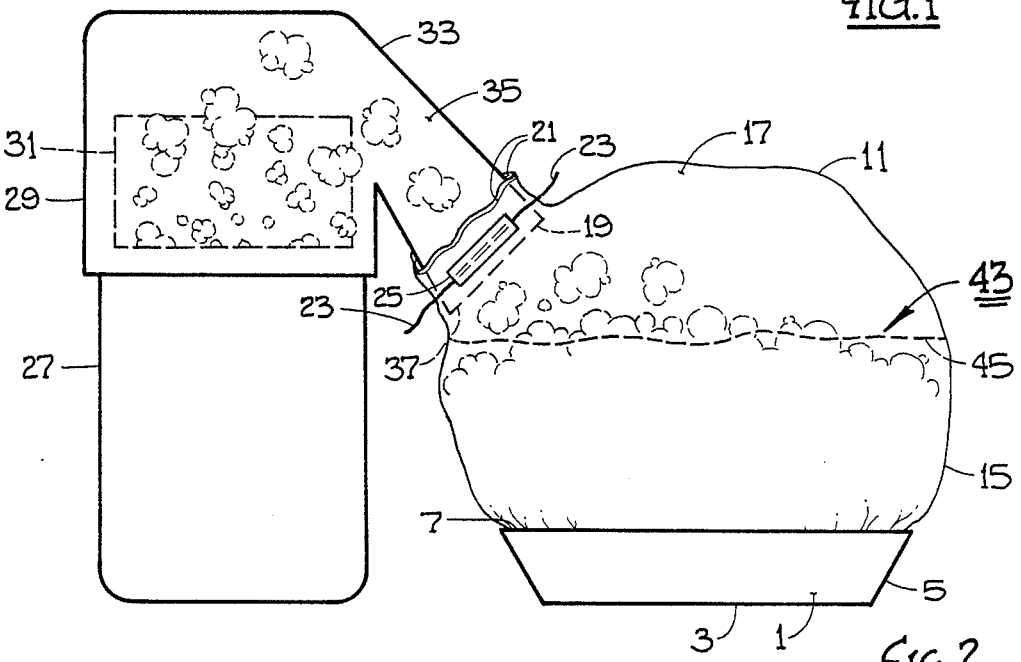
FIG. 2 is a side elevation view, partially in phantom, of the invention used in conjunction with a typical hot-air type corn popper.
Figure 3:
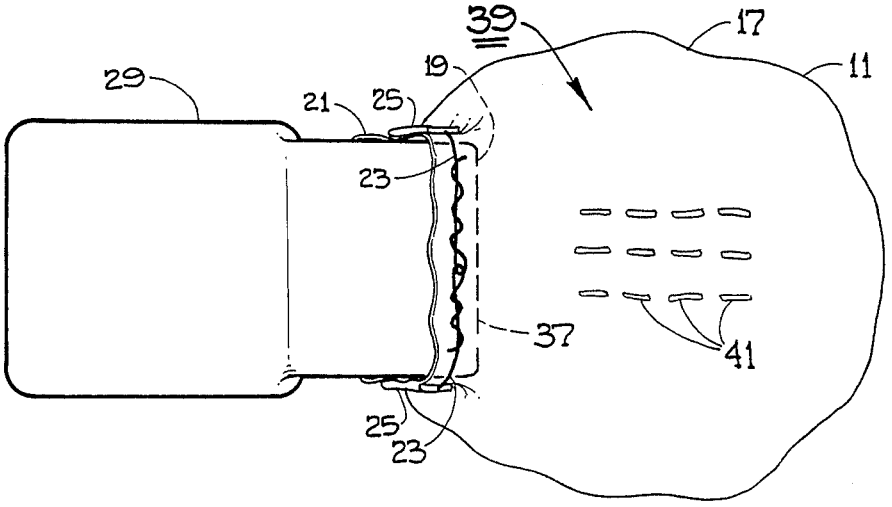
FIG. 3 is a top plan view of the embodiment and corn popper shown in FIG. 2.

Inside depression 9 in flat-folded arrangement is an expansible pouch 11 that is expandable into a round or rotund bowl-like shape as shown in FIGS. 2 and 3. Pouch 11 is defined by a bottom portion 13, for attachment to base 1, either throughout the surface defined by the top surface of flat bottom side 3 or the inner surfaces of border 5, i.e., the surface of depression 9, or along the inner surface defined by border 5 or, at the very least, adjacent and attached to upper rim 7. Conterminous side walls 15 extend upward from bottom portion 13 to form the enclosed rotund, bowl-like receptacle shown in FIGS. 2 and 3. Pouch 11 also includes a top cover 17 integral therewith that completes the rotund, bowl-like shaped receptacle.

The geometry or shape of pouch 11 in its expanded form may takes shapes other than that of a rotund bowl. For instance, it may be of cylindrical shape with top cover 17 closing over the cylinder; or cubical shaped or trapezoidal, etc. All of these shapes are contemplated within the spirit and scope of this invention.

An aperture 19 is formed in pouch 11 preferably in top cover 17 at a point convenient to register with the terminal end of the discharge chute of the particular corn popper utilized. Aperture 19 may be circular or take other geometries; for ease in manufacture and to be adaptable to most corn popper discharge chutes, the preferred configuration is rectangular. Aperture 19 is bounded by a plurality of extended margins or flaps 21 extending thereabout from pouch 11 and integral therewith. In the preferable configuration of a rectangle, aperture 19 would be bounded with four flaps 21, each one extending from one length of the rectangle. A pair of wires 23, either of metal or plastic, extend lengthwise from each of one pair of opposed flaps 21, as shown in FIG. 2, attached to the respective flap by a short strip of adhesive-coated tape 25 overlying each wire 23 and stuck to the outer surface of the respective flap. The terminal ends of wires 23 extend beyond the sides of flap 21.

Pouch 11 may be made from virtually any sheet-like flexible material that, as will be hereinafter explained, will retain a fixed configuration when folded and unfolded or expanded. Chief among the candidates for this construction is paper in various weights and from various sources such as rag or recycled paper. As pouch 11 and base 1 will be in contact with food stuffs, it is important to have the material from which they are made of a purity to be free from contaminants or other harmful substances. Paper is ideal for this purpose as the paper-making process utilizes acids, alkalies and temperatures in ranges that render bacteria and viruses impotent. Metal foil may be used but it is expensive, tears easily and will not absorb pop-corn oils as well as paper thus forcing all of the processing and flavoring oils to remain on the popped corn to be ingested.

In FIG. 2 is shown the invention in use with a corn popper. The typical corn popper useful with this invention comprises a base 27 in which an air blower and an air heater (not shown) are located. Fixed atop base 27 is a popper body 29 containing a kernel support plate (not shown) with slots or other passageways formed therethrough defining a popping zone 31. A transition duct 33 is formed above body 29, to convey the pop corn from zone 31 and, in addition, to contain means for providing flavorful oils such as butter in melted form to the newly popped corn. said duct 33 terminates in a discharge chute 35, formed a discharge port 37 at its outermost end from which the popped corn emerges. Hot air, of a velocity sufficient to slightly levitate and agitate the unpopped kernels, passes upward through the slots in the kernel support plate to heat the kernels to the requisite popping temperature. The popped kernels are lifted by the air from the plate and conveyed through duct 33 to discharge chute 35 and out port 37. It is this operation that creates the hazard previously mentioned i.e., that some kernels are heated to popping temperature however, before they have a chance to pop, they are trapped by other popped kernels and swept out of the popper into the container thereafter to pop and drive other popped corn out of the serving dish and possibly explode popped kernels in someone's face or eyes.

This invention is utilized by first pulling pouch 11 out of its folded configuration in base depression 9 into an up-standing shape. One's hands and fingers may be inserted through aperture 19 into the pouch to aid in establishing the desired shape. The pouch is not expanded by the hot air and vapors discharging from the corn popper but is configured prior to connection with the corn popper. Then base 1 is placed close to the corn popper and discharge port 37 of chute 35 is inserted a short distance into pouch aperture 19. Flaps 21 are then folded about discharge chute 35 to seal it therein. There is no need for a perfect seal as the reason for folding flaps 21 thereabout is only to trap popped corn in pouch 11, not shut off the airflow. The terminal ends of wires 23 may be bent over the non-wire covered flap 21 therebetween and pigtailed or interwoven thereover to secure flaps 21 about discharge chute 35 as shown in FIG. 3.

First means 39 is provided to permit hot air, from the corn popper and water vapor from the corn popping operation, to exhaust pouch 11. Means 39 must, however, not allow escape of popped kernels or of unpopped kernels from the interior of pouch 11. In FIG. 3 is shown a plurality of small apertures 41 formed in pouch top cover 17 to exhaust the vapors therethrough. Means 39 could also take the form of slits cut in pouch 11.

Figure 4:
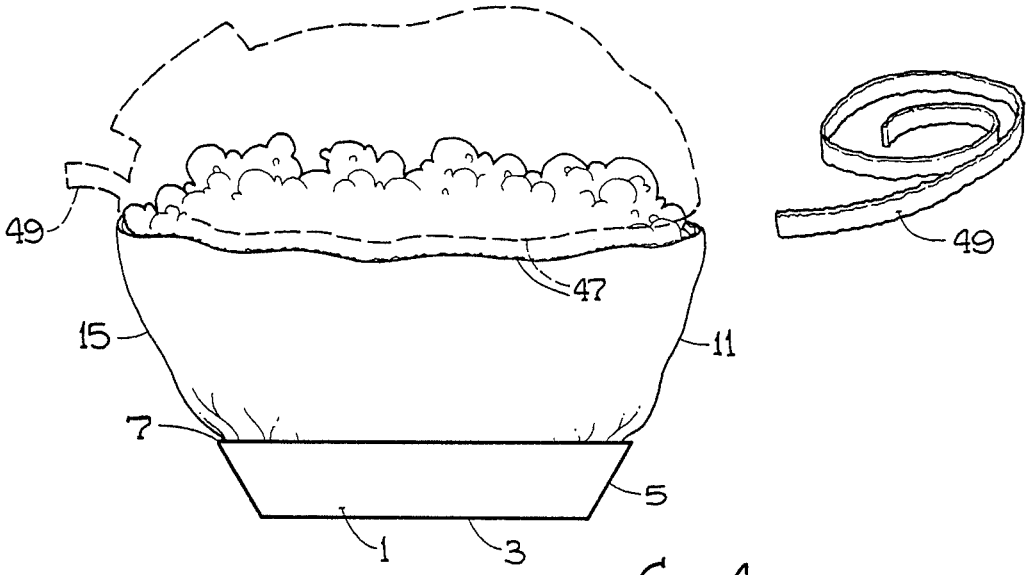
FIG. 4 is a side elevation view of the invention after the top of the pouch has been removed to render the pouch useful as a serving container for the popped corn; and, FIG. 5 is a side elevation view of the pouch shown in FIG. 4 in a folded-over configuration for use as a storage container for the uneaten popped corn.

After the corn is popped, pouch top cover 17 is only required if the corn is to be stored before being served. When it is to be served, cover top 17 must be removed. Second means 43 is provided for aiding the separation of cover 17 from the rest of pouch 11. Means 43 is shown in FIG. 2 as comprising a line of perforations 45 circumscribing or laterally encircling pouch side walls 15. Top cover 17 may thus be removed by carefully tearing along perforations 41. Another form of second means 43 is shown in FIG. 4 where two narrowly spaced lines of perforations 47 are made to circumscribe or laterally encircle pouch side walls 15 to form a tearable or removable strip 49 therebetween for removal as shown. In this view, top cover 17, lines of perforation 47 and removable strip 49 are shown in place in phantom or dotted outlines.

Figure 5:
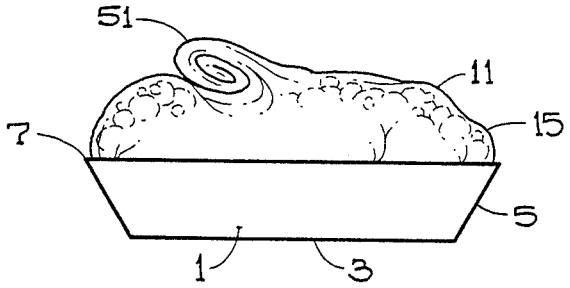

Finally, FIG. 5 shows pouch 11 minus top cover 17 used as a storage container where the top portion of side walls 15 are folded together at 51 in fixed configuration over the uneaten popcorn. This inventive pouch may be used with a wide variety of expandable foods, in addition to popcorn, and they are all fully contemplated within the scope and spirit of this invention.

What I claim is:

1. A combination popping corn receptacle, popped corn server and storage container comprising:

(a) a base having a flat bottom defined by short, upwardly-exending bordering side walls to form a shallow depression therein; and, (b) an expansible pouch, folded substantially flat to fit in said depression comprising, in its expanded form:

(1) a bottom portion for attachment to said base from which said pouch expands upward;

(2) conterminous side walls extending upward from said bottom portion forming a rotund, bowl-like receptacle for receiving popped corn therein;

(3) a top cover integral with said side walls to form an enclosed pouch;

(4) said pouch having formed therein an aperture, bounded by a plurality of outwardly extending flaps integral therewith, adapted to register with and receive therein the terminal end of the discharge chute of a hot-air type corn popper, said flaps adapted to be deformed to generally seal about chutes of various sizes and shapes;

(5) first means in said pouch to exhaust hot gasses therefrom while retaining the popped corn, unpopped corn and late popping corn therein; and, (6) second means laterally surrounding said side wall for completely separating said top cover from said pouch to open said pouch and provide an open receptacle atop said bottom portion for containing and serving popped corn therein;

(7) said pouch comprised of a sheet-like material adapted to be folded in fixed configuration to store popped corn therein.

2. The combination of claim 1 wherein said first means includes a plurality of apertures formed in said top cover of a size smaller than unpopped corn kernels.

3. The combination of claim 1 wherein said first means includes a plurality of slits formed in said top cover.

4. The combination of claim 1 wherein said second means comprises a line of perforations.

5. The combination of claim 1 wherein said second means comprises a pair of narrowly spaced lines of perforation forming a tearable strip for removal to separate said top cover from said pouch.

6. The combination of claim 1 further including a pair of wires extending lengthwise from an opposed pair of said flaps, held thereto by an overlying strip of adhesive tape, having terminal ends extending beyond the ends of said flaps for intertwining over said other flaps to seal said pouch about the discharge chute of the corn popper.

* * * * *